United States Patent [19]

Dupasquier

[11] Patent Number: 4,734,971

[45] Date of Patent: Apr. 5, 1988

[54] METHOD OF MECHANICALLY CRIMPING OVERLAPPING SHEET METAL

[75] Inventor: Robert L. Dupasquier, Wood Dale, Ill.

[73] Assignee: Aro Metal Stamping Co., Inc., Addison, Ill.

[21] Appl. No.: 2,132

[22] Filed: Jan. 12, 1987

[51] Int. Cl.[4] ..... B23P 17/00; B23P 11/00; B21D 39/00

[52] U.S. Cl. ..... 29/417; 29/513; 29/521; 138/166; 220/76; 312/261

[58] Field of Search ..... 29/417, 513, 521, 505; 403/285; 220/76; 138/166; 312/261

[56] References Cited

U.S. PATENT DOCUMENTS

| | | | |
|---|---|---|---|
| 2,115,367 | 4/1938 | Levy | 29/513 UX |
| 2,427,393 | 9/1947 | Eckel | 29/521 X |
| 2,625,723 | 1/1953 | Bassett | 29/521 UX |
| 2,843,725 | 7/1958 | Granberg | 29/513 UX |
| 2,912,075 | 11/1959 | Pfistershammer | 29/521 X |
| 3,034,209 | 5/1962 | Bianca et al. | 29/521 X |
| 3,071,214 | 1/1963 | Steinbichler | 29/521 X |
| 3,105,295 | 10/1963 | Calhoun et al. | 29/521 UX |
| 3,286,314 | 11/1966 | Oetiker | 29/513 X |
| 3,728,881 | 4/1973 | Coop | 29/521 |
| 3,952,409 | 4/1976 | Allison et al. | 29/417 X |

FOREIGN PATENT DOCUMENTS

| | | | |
|---|---|---|---|
| 364598 | 11/1962 | Switzerland | 29/513 |

*Primary Examiner*—Charlie T. Moon

*Attorney, Agent, or Firm*—Mason, Kolehmainen, Rathburn & Wyss

[57] ABSTRACT

A method of joining first and second flat sheet metal portions in overlapping relation one above the other to form a joint in the two sheet metal portions. Metal adjacent and spaced from one free edge of a first sheet metal portion is cut parallel to the free edge and expanded to form a generally U-shaped female receptacle arcuately domed and tapered inwardly and downwardly in a direction away from the free edge. The second sheet metal portion is cut in a truncated V-shape and the V-shape cut is bent to form a generally truncated, V-shaped male prong bent at an angle with respect to the second sheet metal portion. The first and second sheet metal portions are forced into overlapping engagement, one above the other, progressively, while directing the male prong into the female receptacle. The overlapped sheet metal portions then are crimped or pressed together to flatten the domed female receptacle and form complementary L-shaped bends in the two sheet metal portions, secured on both sides of foot portions of the L-shaped bends with metal from the other sheet metal portion.

17 Claims, 2 Drawing Sheets

Fig. 1
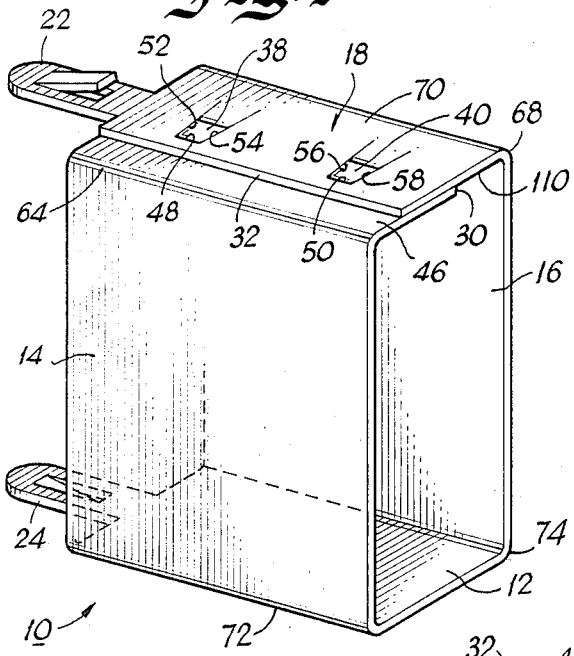
Fig. 2
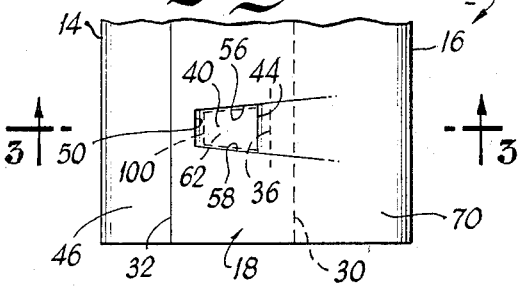
Fig. 3
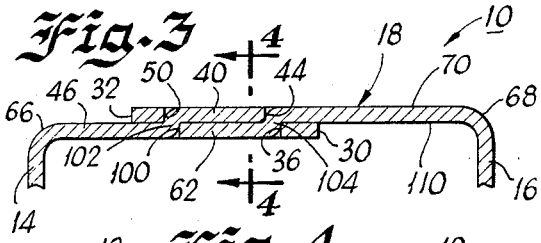
Fig. 4
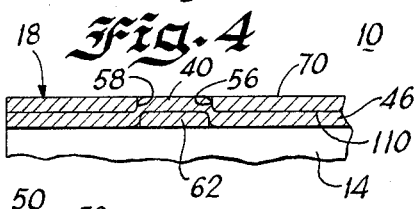
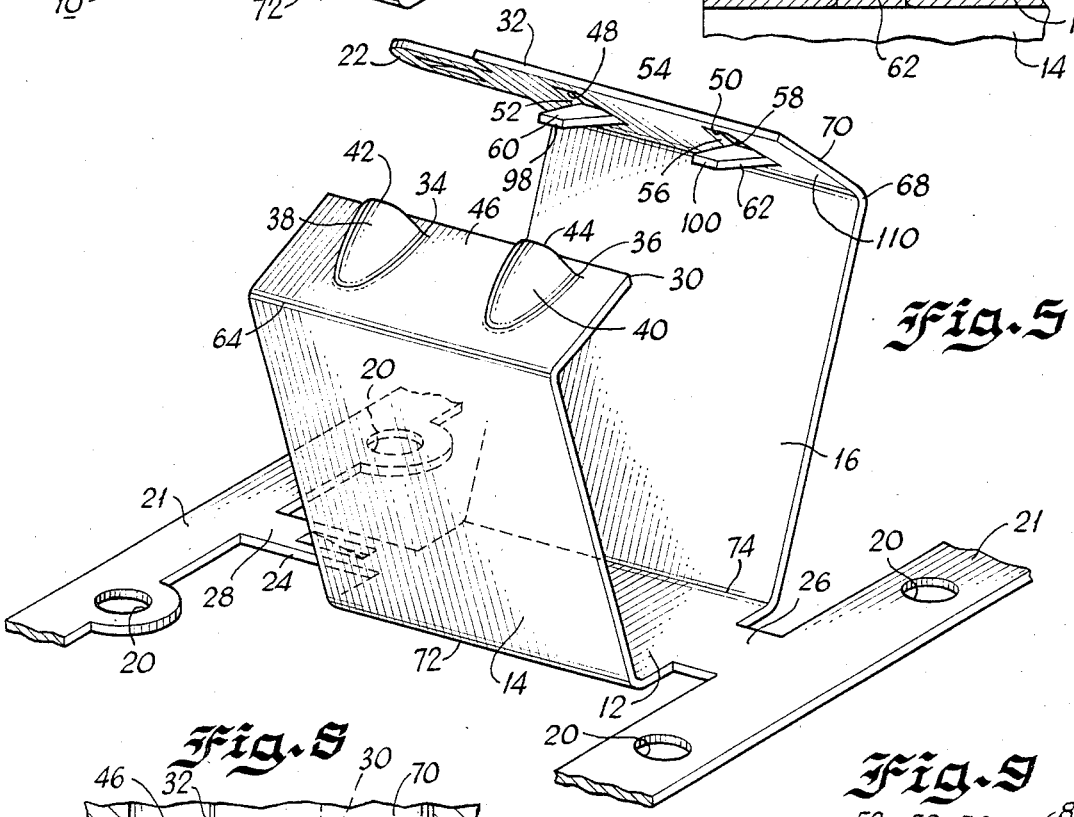
Fig. 5
Fig. 8
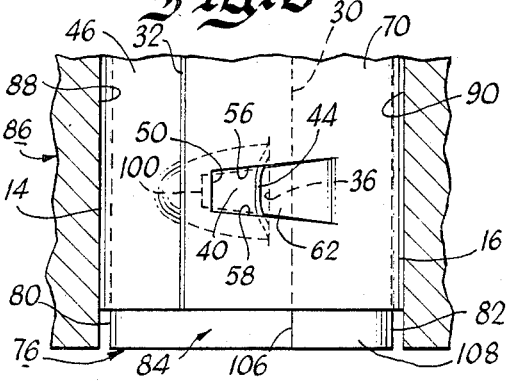
Fig. 9
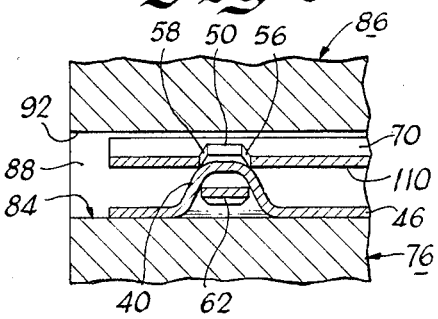

METHOD OF MECHANICALLY CRIMPING OVERLAPPING SHEET METAL

FIELD OF THE INVENTION

The present invention is directed to a method of joining first and second flat sheet metal portions in overlapping relation one above the other to form a rectangular housing having a mechanical, interlocked joint in the overlapping sheet metal portions. More particularly, the present invention is directed to a continuous method of forming a mechanically interlocked joint in overlapping sheet metal stock where the overlapped sheet metal stock is securely interlocked in a double sheet metal thickness without spot welding and without protruding metal portions extending above or below the double thickness of overlapping sheet metal stock.

BACKGROUND OF THE INVENTION AND PRIOR ART

There are many known processes for joining or uniting metallic sheets in an overlapping fashion including spot welding, tongue and groove type fittings, inserting a metallic locking-core into channels formed in the overlapping sheet material, using rivets, and the like in forming metallic boxes, housings and electrical or heat shields. Some of these methods and the resulting box or rectangular housing structures are shown in the following U.S. Pat. Nos.: Bianca et al 2,815,568; Pfister et al 2,916,181; Oetiker 3,286,314; Coop 3,824,757; Krantz 1,557,066; Walter et al 4,550,479; Pfistershammer 2,663,072; Cooley 2,426,670; Dieckmann 597,056; Plecker 518,767 and Brown et al 454,636. In general, the mechanical crimping methods of the prior art in the formation of a lap joint or seam between two overlapping sheet metal ends has been a simple mechanical crimp, formed in a separate secondary operation, forcing an end of one overlapping metal sheet portion under an end or aperture in the other sheet metal portion to form a mechanical interlock suitable for most purposes. This type of mechanical interlock, for example, is shown in the above-identified Bianca et al, Pfister et al, Oetiker and Coop patents.

Spot welding, used for many years in producing electrical shields in a rectangular sheet metal box type structure having one or more open ends is a much more expensive process than mechanical crimping due to the additional labor, machinery and time necessary for an extra, secondary process step and station for each housing or shield. However, prior to the present invention, it was felt that spot welding was necessary in order to produce an electrical shield or other housing structure having sufficient joint or seam strength to maintain the structural integrity of the seam or joint. Spot welding, however, generally secures overlapping sheet metal portions only in the area of spot welding and cannot produce a seam wherein the overlapping sheet metal portions are in direct contact over essentially 100% of the surface area of the overlapping sheet metal portions.

The above disadvantages in spot welding and other mechanically crimped seams of the prior art have been overcome in accordance with the principles of the present invention.

SUMMARY OF THE INVENTION

In brief, the present invention is directed to a method of joining first and second flat sheet metal portions in overlapping relation one above the other in a continuous process to form a joint in the two sheet metal portions. Metal adjacent and spaced from one free edge of a first sheet metal portion is cut parallel to the free edge and expanded to form a generally U-shaped female receptacle arcuately domed and tapered inwardly and downwardly in a direction away from the free edge. The second sheet metal portion is cut in a truncated V-shape and the V-shape cut is bent to form a generally truncated, V-shaped male prong bent at an angle with respect to the second sheet metal portion. The first and second sheet metal portions are forced into overlapping engagement, one above the other, progressively, while directing the male prong into the female receptacle. The overlapped sheet metal portions then are crimped or pressed together to flatten the domed female receptacle and form complementary L-shaped bends in the two sheet metal portions, secured on both sides of the foot portion of the L-shaped bends with metal from the other sheet metal portion.

Accordingly, an object of the present invention is to provide a method of joining first and second flat sheet metal portions in overlapping relation one above the other by expanding, bending and mechanically crimping together the overlapping sheet metal portions such that the overlapping sheet metal portions are in substantially complete contact one with the other.

Another object of the present invention is to provide a method of forming a lap joint or seam in overlapping sheet metal stock to form a sheet metal housing or shield having new and unexpected structural integrity.

Another object of the present invention is to provide a method of joining first and second flat sheet metal portions in overlapping relation one above the other without spot welding.

Still another object of the present invention is to provide a new and improved method of joining first and second flat sheet metal portions in overlapping relation one above the other to provide substantially flat upper and lower surfaces at a mechanical interlock between the overlapping sheet metal portions without any extraneous metal extending above or below the double thickness in the area of the overlap.

A further object of the present invention is to provide a new and improved method of joining first and second sheet metal portions in overlapping relation wherein the overlapping sheet metal portions are mechanically interlocked to provide substantially complete contact of the overlapping portions of the sheet metal stock to provide a mechanical interlock that is difficultly detectable by feel and eye.

Another object of the present invention is to provide a method of continuously mechanically joining two sheet metal portions in overlapping relation one over the other while the part is maintained removably connected to one or more carrier strips without the necessity of a secondary spot welding or other operation at a station separated from a single assembly line so that the sheet metal portions do not need to be handled individually to complete the joint forming operation.

The above and other objects and advantages of the present invention will become more apparent with reference to the following detailed description of a preferred embodiment taken in conjunction with the drawings.

BRIEF DESCRIPTION OF THE DRAWINGS

FIG. 1 is a perspective view of the sheet metal electrical shield made in accordance with the method of the present invention;

FIG. 2 is a partially elevational, partially broken away top view of the sheet metal shield of FIG. 1;

FIG. 3 is a cross-sectional view of the mechanical interlock formed in accordance with the method of the present invention taken along the line 3—3 of FIG. 2;

FIG. 4 is a cross-sectional view of the mechanical interlock formed in accordance with the method of the present invention taken along the line 4—4 of FIG. 3;

FIG. 5 is a perspective view of the sheet metal electrical shield of FIG. 1 during the process of manufacture prior to joining free ends of sheet metal into overlapping relation and prior to crimping the mechanical interlock into its final form shown in FIG. 1;

FIG. 8 is a partially broken away, partially elevational top view taken along the line 8—8 of FIG. 7 showing the sheet metal shield in the course of manufacture in accordance with the present invention just prior to final crimping of the overlapping sheet metal portions into their final interlocked configuration;

FIG. 9 is a partially broken away, partially elevational top view taken along the line 9—9 of FIG. 7 showing the sheet metal shield in the course of manufacture in accordance with the present invention just prior to final crimping of the overlapping sheet metal portions into their final interlocked configuration.

DETAILED DESCRIPTION OF THE PREFERRED EMBODIMENT

Figure 7:
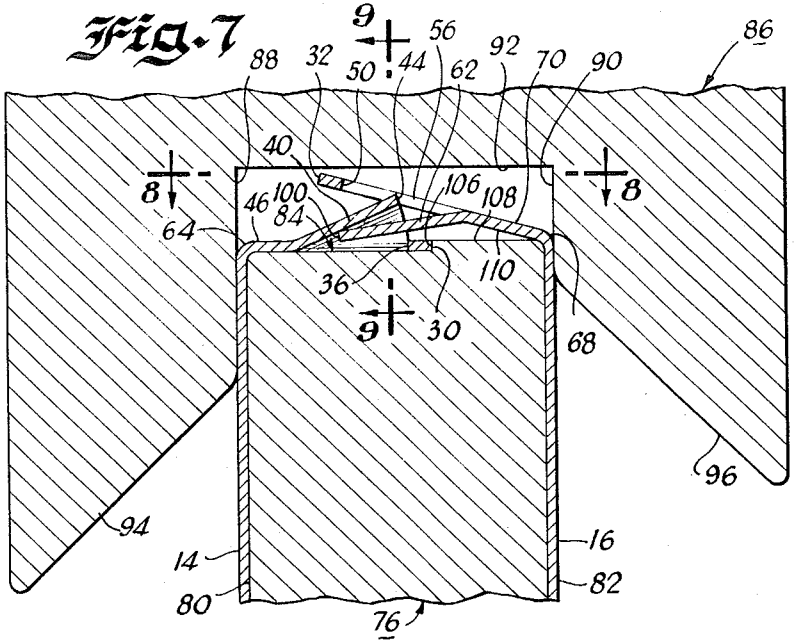
FIG. 7 is a cross-sectional view of the sheet metal electrical shield formed in accordance with the method of the present invention at a joint forming or crimping station after alignment of the mechanically interlocking portions of the overlapping sheet metal and prior to crimping.

Turning now to the drawings, and initially to FIG. 1, there is shown an electrical or heat shield, or sheet metal housing generally designated by reference numeral 10, manufactured in accordance with the new and improved method of the present invention. The rectangular housing 10 generally includes four walls, described with respect to their disposition during the manufacturing process of the present invention, as bottom wall 12, sidewalls 14 and 16 and top or joint wall generally designated by reference numeral 18. The shield 10 is cut and formed as generally known in the art by starting with an elongated sheet of metallic stock, and initially forming spaced registration holes 20 (FIG. 5) in carrier strips 21 for carrying the sheet metal stock to various manufacturing stations, as will be described in more detail hereinafter.

In a first manufacturing step well known in the art, the sheet metal is punched or otherwise formed while flat into a generally rectangular form, generally including one or more PC board attaching tabs 22 and 24, while maintaining the bottom wall 12 interconnected to the carrier strips 21 with integral connection tabs 26 and 28, later removed as a final manufacturing step. After formation into the flat, generally rectangular form, the sheet metal is deformed in locations spaced from the sheet metal free ends 30 and 32 to prepare the sheet metal to be interlocked with the free edges 30 and 32 in overlapping relation. Adjacent the free end 30 of the sheet metal stock, a pair of longitudinal slits 34 and 36 are formed, generally parallel to the free end 30, and the sheet metal is expanded upwardly from the slits 34 and 36 to extend upwardly from the slits 34 and 36 to form dome-shaped female receptacles 38 and 40. The dome-shaped receptacles are in the form of closed-end tunnels having free edges 42 and 44 generally in the shape of a hyperbola and tapered inwardly and downwardly in a direction away from the free edge 30 to be integral with a top overlapping shield wall portion 46. The metal adjacent the other free end 32 of the other overlapping metal is portion 70 cut in one or more locations spaced from the free edge 32 in a general shape of a truncated V wherein truncated cuts 48 and 50 are spaced from and parallel to the free edge 32. Truncated cut 48 is interconnected with angled side cuts 52 and 54 converging in a direction toward free end 32 and truncated cut 50 is interconnected with angled side cuts 56 and 58 converging in a direction toward free end 32. The metal between the truncated V-shaped cuts is bent downwardly to form one or more tapered prongs 60 and 62 adapted to be received within the dome-shaped female receptacles 38 and 40, respectively. After formation of the dome-shaped female receptacles 38 and 40 and the tapered prongs 60 and 62, as described, the sheet metal is bent at right angles, in the same direction, at bends 64 and 68 along lines parallel with free ends 30 and 32, respectively, as best shown in FIG. 5, to form the overlapping top wall portions 46 and 70, overlapped and interlocked in accordance with the method of the present invention, to form top wall 18.

In accordance with an important feature of the present invention, the sheet metal stock is next deformed by bending it upwardly at bends 72 and 74 to define the bottom wall 12 and sidewalls 14 and 16. The bends 72 and 74 are not completely formed at this stage of the manufacturing process so that included angles between the inner surface of bottom wall 12 and the inner surface of sidewalls 14 and 16 are more than 90° and sufficient to prevent the upper wall portions 46 and 70 from being aligned in overlapping relation. Generally, included angles of about 100° to 150° between the bottom wall 12 and the inner surfaces of sidewalls 14 and 16 are sufficient angles to prevent the top wall portions 46 and 70 from being aligned in overlapping relation at this stage in the manufacturing process. The shield at this stage in the manufacturing process is shown in FIG. 5.

After formation of the domed female receptacles 38 and 40 and the tapered prongs 60 and 62; after the right angle top wall portions 46 and 70 are bent at right angles to sidewalls 14 and 16; and after formation of the partially complete bends 72 and 74 defining the bottom wall 12 and sidewalls 14 and 16, a rigid solid steel arbor, generally designated 76 is inserted into the shield 10. The arbor 76 includes a bottom wall 78, two sidewalls 80 and 82 and a stepped top wall, generally designated 84 and is disposed to lie on bottom wall 12 to act as a male die configuration for final formation of the shield 10 in accordance with the process of the present invention. The arbor 76 and surrounding shield or housing 10, while still attached to the carrier strips 21, then are disposed beneath a female die generally designated by reference numeral 86, having a rectangular die opening defined by planar sidewall 88, opposite planar sidewall 90 and a planar top wall 92.

In accordance with an important feature of the present invention, the female die includes tapered, planar sheet metal forming walls 94 and 96 which operate to contact the sidewall 14 and then sidewall 16 at right angle bends 64 and 68 in a progressive fashion to force the sidewalls 14 and 16 of the shield 10 against the sidewalls 80 and 82, respectively, of the arbor 76. The tapered sidewall 94 is tapered downwardly in a direction away from the planar sidewall 88 of the female die opening and tapered wall 96 is tapered downwardly in a direction away from female die sidewall 90 for progressively forcing the sidewalls 14 and 16, against the arbor sidewalls 80 and 82 with the sidewall 14 containing ferrule receptacles 38 and 40 being forced against arbor wall 80 during and ahead of the sidewall 16 being forced against arbor sidewall 82. In this manner the top wall portions 46 and 70 are formed automatically and sequentially toward each other in overlapping relationship while forcing the male prongs 60 and 62 into the domed female receptacles 38 and 40, as best shown in FIG. 7, while the housing 10 is maintained integral with the carrier strips 21.

In accordance with another important feature of the present invention, the rectangular female die opening formed by planar sidewalls 88 and 90 and planar top wall 92 is dimensioned such that the sidewalls 14 and 16 of the shield 10 are forced completely against the sidewalls 80 and 82 of the arbor 76 while forcing the prongs 60 and 62 into the female receptacles 38 and 40 prior to any contact of the planar female die top wall 92 against either top wall portion 46 and 70 to make sure that the prongs 60 and 62 are properly positioned within the female receptacles 38 and 40 prior to any crimping action of the top female die wall 92 and top arbor wall 84 to interlock the top walls 46 and 70 together in accordance with the principles of the present invention (FIG. 7). From the position shown in FIG. 7, the arbor 76 and female die 86 are converged to flatten the domed female receptacles 38 and 40 and to bend each female receptacle in an L-shape between the slits 48 and 50 made in top wall portion 70 and end edges 98 and 100 on prongs 60 and 62, as shown at 102 in FIG. 10. This process step also bends the prongs 60 and 62 into a complementary L-shaped configuration between the free edges 42 and 44 of the female receptacles 38 and 40 and the slits 34 and 36 made in top wall portion 46, as shown at 104 in FIG. 10.

In accordance with another important feature of the present invention, the top wall 84 of arbor 76 has a stepped upper surface formed by perpendicularly upward extending step wall 106 integral with and perpendicular to uppermost top wall 108 so that uppermost top wall 108 supports an undersurface 110 of top wall portion 70 adjacent free end 32 of upper wall portion 46 to maintain top wall portion 70 planar during crimping.

Figure 10:
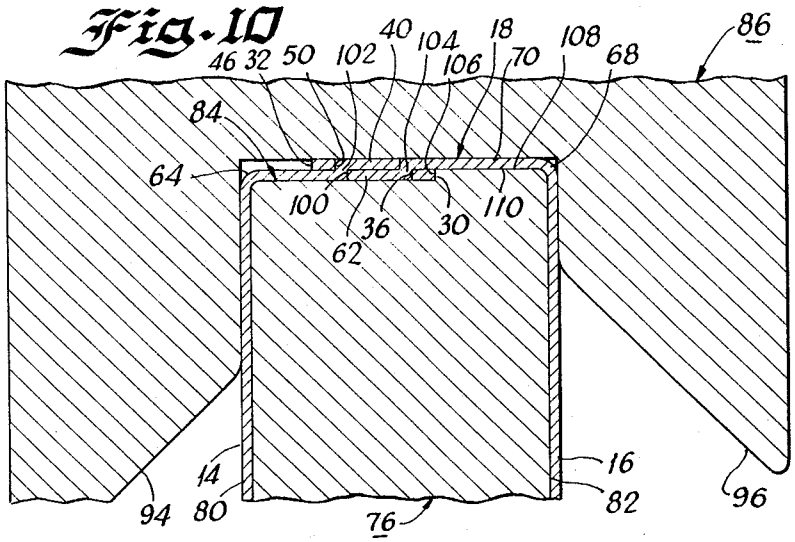
FIG. 10 is a partially broken away cross-sectional view showing the sheet metal shield in completed form after final crimping.
Figure 6:
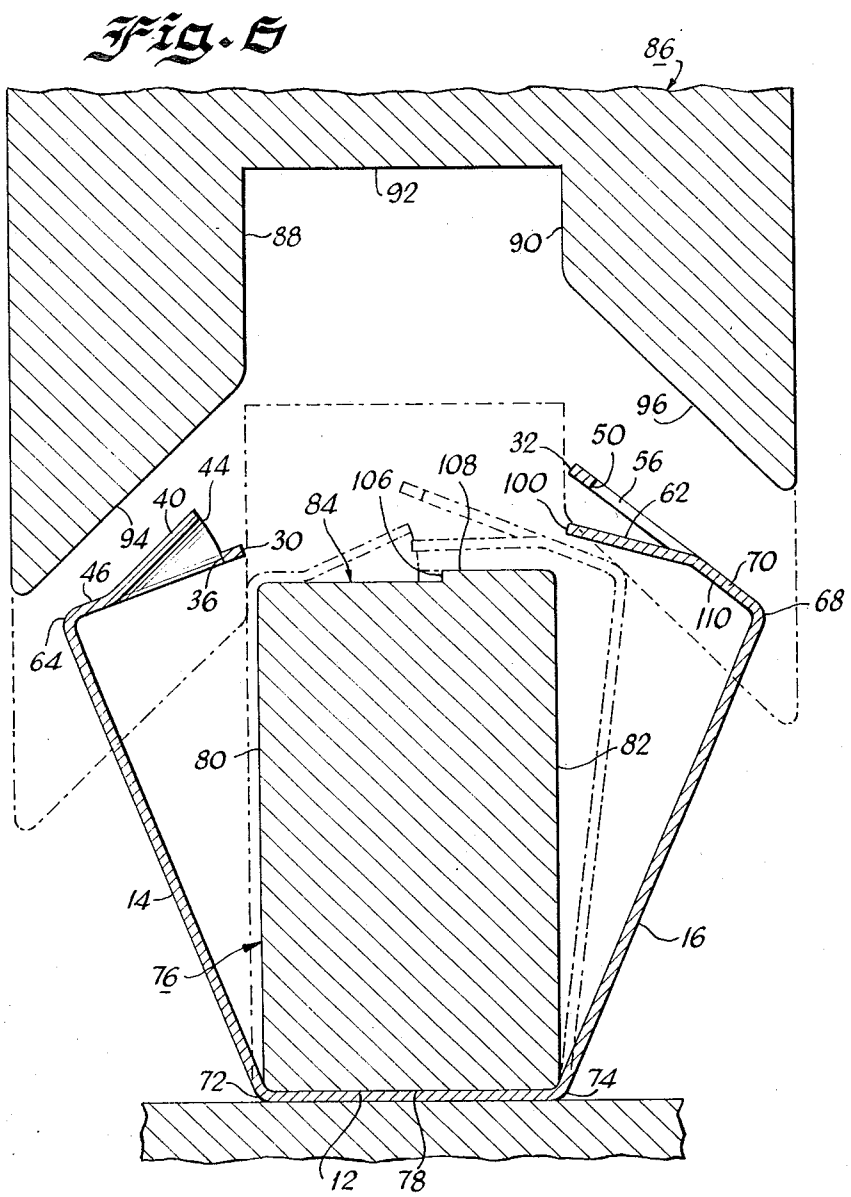
FIG. 6 is a cross-sectional view of the sheet metal electrical shield formed in accordance with the method of the present invention at a joint forming or crimping station that forces the free ends of the sheet metal stock into overlapping relation and thereafter mechanically interlocks the overlapping portions.

This interlocking configuration formed in accordance with the process of the present invention has new and unexpected structural integrity without extraneous metal extending above or below the double wall thickness in the overlapping area of the joint, as shown in FIG. 10. Further, in accordance with the method of the present invention the overlapping area of top wall portions 46 and 70 are in essentially 100% complete contact to prevent electrical or heat leakage from the top wall 18 of the sheet metal housing 10.

While there has been described what is at present considered to be the preferred embodiment of the invention, it will be understood that various modifications may be made therein which are within the true spirit and scope of the invention.

What is claimed as new and desired to be secured by Letters Patent of the United States is:

1. A method of joining first and second flat sheet metal portions in overlapping relation one above the other to form a sheet metal housing having a crimped sheet metal joint in said two sheet metal portions comprising:

cutting and expanding metal adjacent and spaced from a free edge of first sheet metal portion while said first sheet metal portion is integrally attached to an assembly line carrier strip to form a dome-shaped female receptacle and open toward said edge;

cutting and bending metal adjacent and spaced from a free edge of said second sheet metal portion while said second sheet metal portion is integrally attached to an assembly line carrier strip to form a male prong extending toward said free edge adapted to be received within said female receptacle;

bending said two sheet metal portions toward each other at one pressing station to define two planar sidewalls and a planar intermediate wall between said bends wherein at least one of said bends defines an included angle between one of said planar sidewalls and said planar intermediate wall of greater than 90°;

continuing to bend said two planar sidewalls at a separate pressing station to form 90° included angles between said two planar sidewalls and said said planar intermediate wall to force said male prong into said female receptacle, while said two sheet metal portions are maintained integral with said assembly line carrier strip;

pressing said first and second sheet metal portions together to interlock the two sheet metal portions securely in place at said sheet metal joint; and separating said sheet metal housing from the carrier strip.

2. The method of claim 1 wherein said sheet metal housing is separated from the carrier strip as a final forming operation.

3. The method of claim 1 including inserting an arbor into the housing to bend the sheet metal portions toward each other about an arbor bottom wall to define at least one included angle between the intermediate wall of the housing and a housing sidewall of greater than 90°, and, at a separate pressing station, progressively pressing the sidewalls toward each other, with one sidewall leading the other, to insert the male prong within the female receptacle, without interference.

4. The method of claim 3 wherein the sidewall integral with a wall portion carrying the female receptacles is pressed inwardly toward the arbor before pressing the sidewall integral with the male prong to align the male prong within the female receptacle prior to interlocking the male prong within the female receptacle.

5. The method of claim 3 wherein the arbor and surrounding sheet metal housing are aligned with a female die having a female die opening and outwardly extending and tapered flange walls so that when the arbor and female die are converged, the tapered, extending female die flange walls press the housing sidewalls against the arbor to complete the 90° bends and insert the male prong within the female receptacle, prior to interlocking.

6. A method of joining first and second flat sheet metal portions in overlapping relation one above the other to form a joint in said two sheet metal portions comprising:

cutting and arcuately expanding metal adjacent and spaced from an edge of said first sheet metal portion to form an elongated generally U-shaped female receptacle arcuately domed above said first flat sheet metal portion and tapered inwardly and downwardly in a direction away from a free edge of said first sheet metal portion and open toward said edge;

cutting and bending said second sheet metal portion adjacent and spaced from an edge of said second flat sheet metal portion to form a generally V-shaped male prong in the form of a quadrilateral having a side farthest from a free end of the second sheet metal portion integral with the second sheet metal portion, said prong bent at an angle with respect to said second sheet metal portion and extending toward said edge of said second portion;

forcing said first and second sheet metal portions into contact, one above the other, while directing the male prong into the female receptacle with a portion of the prong disposed above the free edge of the first sheet metal portion and the free edge of the second sheet metal portion disposed above the female receptacle; and pressing the first and second sheet metal portions together in a direction perpendicular to the flat sheet metal portions to form an L-shaped bend in the prong defined by a planar leg portion of the prong disposed in contact with a planar portion of the female receptacle, and a planar foot portion of the prong perpendicular to a cut end of the female receptacle, while flattening the female receptacle and forming a complementary L-shaped bend in the female receptacle defined by a planar leg portion of the L-shaped receptacle bend in contact with the planar leg portion of the prong and a foot portion of the L-shaped receptacle bend perpendicular to the cut edge of the prong, to lock the first and second sheet metal portions together.

7. The method of claim 6 wherein said sheet metal is integrally attached to a carrier strip during said manufacturing steps and wherein the sheet metal is separated from the carrier strip as a final forming operation.

8. The method of claim 6 including inserting an arbor between the two sheet metal portions to bend the sheet metal portions toward each other, about an arbor bottom wall to define at least one included angle between an intermediate wall and the sidewalls of greater than 90°, and at a separate pressing station, progressively pressing the sidewalls toward each other, with one sidewall leading the other, to insert the male prong within the female receptacle, without interference.

9. The method of claim 6 wherein the sidewall integral with a wall portion carrying the female receptacles is pressed inwardly toward the arbor before pressing the sidewall integral with the male prong to align the male prong within the female receptacle prior to interlocking the male prong within the female receptacle.

10. The method of claim 6 wherein the arbor and surrounding sheet metal portion are aligned with a female die having a female die opening and outwardly extending and tapered flange walls so that when the arbor and female die are converged, the tapered, extending female die flange walls press the sidewalls against the arbor to complete the 90° bends and insert the male prong within the female receptacle, prior to interlocking.

11. A method of forming a sheet metal rectangular housing from flat sheet metal stock comprising:

cutting the sheet metal stock parallel to and spaced from a first free edge thereof and expanding the sheet metal adjacent the cut end in a direction away from the first free edge upwardly to form a dome-shaped female receptacle tapered inwardly and downwardly in a direction away from ssaid first free edge and open toward said edge;

cutting the sheet metal stock adjacent and spaced from to an opposite, second free edge thereof to form a pair of spaced, interconnected cuts, and bending the sheet metal disposed between the pair of cuts with respect to said second free edge to form a protruding prong adjacent and extending toward the second free edge;

bending the sheet metal stock at right angles along lines spaced from and parallel to the first and second free edges forming a first bend upwardly in the sheet metal stock along a first line at an angle less than 90° and forming a second bend at an angle less than 90° upwardly in the sheet metal stock along a second line spaced from the first line to form a planar bottom wall defined by the sheet metal stock disposed between the first and second lines, and to form two cocked sidewalls defined by the upwardly bent sheet metal;

disposing a generally rectangular arbor on the bottom wall and between the two cocked sidewalls;

pressing the cocked sidewalls inwardly into contact with said arbor to dispose the sidewalls at a 90° angle with respect to said bottom wall, and to force the prong into the female receptacle; and forming an interlocked upper housing wall by flattening the female receptacle against an upper surface of the arbor over a portion of the prong while bending the prong and the female receptacle into complementary L-shaped interlocked bends such that a portion of the prong is disposed above the first free edge and the second free edge is disposed above the female receptacle, said first and second free edges lying in parallel, spaced planes.

12. The method of claim 11 wherein said sheet metal is integrally attached to a carrier strip during said manufacturing steps and wherein the sheet metal is separated from the carrier strip as a final forming operation.

13. The method of claim 11 including inserting an arbor into the housing to bend the sheet metal portions toward each other, about an arbor bottom wall to define at least one included angle between the intermediate wall of the housing and the housing sidewalls of greater than 90°, and at a separate pressing station, progressively pressing the sidewalls toward each other, with one sidewall leading the other, to insert the male prong within the female receptacle, without interference.

14. The method of claim 11 wherein the sidewall integral with a wall portion carrying the female receptacles is pressed inwardly toward the arbor before pressing the sidewall integral with the male prong to align the male prong within the female receptacle prior to interlocking the male prong within the female receptacle.

15. The method of claim 11 wherein the arbor and surrounding sheet metal housing are aligned with a female die having a female die opening and outwardly extending and tapered flange walls so that when the arbor and female die are converged, the tapered, extending female die flange walls press the housing sidewalls against the arbor to complete the 90° bends and insert the male prong within the female receptacle, prior to interlocking.

16. The method of claim 11 including pressing the cocked sidewalls inwardly by lowering a female die over the upper arbor surface in a direction perpendicular to the bottom wall, said female die including an internal die opening shaped complementary to the arbor and wherein the female die includes a pair of transversely extending tapered sidewalls tapered downwardly and outwardly from the die opening, angled upwardly and inwardly toward the die opening such that lowering the female die presses the cocked sidewalls inwardly against the arbor to from a 90° angle between each sidewall and the bottom wall and forces the prong into the female receptacle adjacent the upper arbor surface.

17. The method of claim 16 wherein the upper arbor surface is step-shaped to support a portion of the upper housing wall during lowering of the female die.

* * * * *